US006313580B1

(12) United States Patent
Makino

(10) Patent No.: US 6,313,580 B1
(45) Date of Patent: Nov. 6, 2001

(54) AC-DISCHARGE TYPE PLASMA DISPLAY PANEL AND METHOD FOR DRIVING THE SAME

(75) Inventor: Mitsuyoshi Makino, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/288,499

(22) Filed: Apr. 8, 1999

(30) Foreign Application Priority Data

Apr. 14, 1998 (JP) ..... 10-103171

(51) Int. Cl.[7] ..... H01J 17/49

(52) U.S. Cl. ..... 313/582; 315/164.1; 315/169.4

(58) Field of Search ..... 313/582, 217, 313/586, 584, 585, 587; 315/169, 169.1, 169.3, 169.4, 160, 168; 340/324; 345/66, 204, 68

(56) References Cited

U.S. PATENT DOCUMENTS 4,105,930 * 8/1978 Coleman ..... 315/169

FOREIGN PATENT DOCUMENTS 49-135576 12/1974 (JP) .
56-73840 6/1981 (JP) .
60-225333 11/1985 (JP) .
61-176035 8/1986 (JP) .
3-219528 9/1991 (JP) .
6-275201 9/1994 (JP) .
8-138558 5/1996 (JP) .
8-328506 12/1996 (JP) .
10-312755 11/1998 (JP) .

* cited by examiner

*Primary Examiner*—Nimeshkumar D. Patel
*Assistant Examiner*—Ken A Berck
(74) *Attorney, Agent, or Firm*—Sughrue, Mion, Zinn, Macpeak & Seas, PLLC

(57) ABSTRACT

A front glass substrate and a back glass substrate are disposed, confronting each other to interpose a certain space therebetween. A discharge gas is enclosed within the space. The space is divided into a plural of display cells and a plural of priming discharge cells. Display data write and sustaining discharges for displaying an image are caused in display cells by priming effects from priming discharge cells. Display cell electrodes control discharges at display cells. A pair of priming discharge electrodes for causing discharges in priming discharge cells is provided independently of display cell electrodes, and is driven independently of display cells. The priming discharge cells are independently of display cells with respect to structure and driving control, and may discharge preliminarily by a sine wave driving method using a low drive frequency.

18 Claims, 9 Drawing Sheets

AC-DISCHARGE TYPE PLASMA DISPLAY PANEL AND METHOD FOR DRIVING THE SAME

BACKGROUND 0F THE INVENTION

1. Field of the Invention

The present invention relates to a plasma display panel of an alternating current discharge type (AC-PDP) for use in a flat display capable of easily realizing a larger display area, such as an output display for a personal computer and a work station as well as a wall-mountable TV, and a method for driving the same.

2. Description of the Related Art

PDPs are classified into a DC type and an AC type on the basis of their structures. The DC-PDP includes electrodes that are exposed in a discharge gas. The AC-PDP includes electrodes that are covered with a dielectric material and not exposed directly in the discharge gas. The AC-PDPs are further classified into a memory operation type PDP which employs a memory function by a charge accumulation effect of the dielectric material, and a refresh operation type PDP which does not use that effect.

FIG. 9 is a cross sectional view showing an example of a general AC-PDP structure. The PDP comprises front glass substrate 10 and back glass substrate 11 to form a certain space therebetween for which there is provided the following structure. A plural of scan electrodes 12 and a plural of common electrodes 13, both extending in a direction normal to the drawing and being apart from one another at a certain distance are disposed on front substrate 10. Scan electrodes 12 and common electrodes 13 are covered with insulating layer 15*a* on which there is formed a protection layer 16 consisting of, for example, MgO for protecting insulating layer 15*a* from discharge.

A plural of data electrodes 19 extending from left to right on the drawing are disposed on back substrate 11 so as to intercross scan electrodes 12 and common electrodes 13 at right angles. Data electrodes 19 are covered with insulating layer 15*b* on which there are formed phosphors materials 18 for converting UV rays derived from discharges into visible lights. In order to obtain a color display PDP, each cell may be coated independently with a different phosphors material that has, for example, one of three primary colors of light; red, green and blue (RGB). FIG. 13 shows an example of the coating of phosphors material on each cell, in which R means red, G green and B blue. FIG. 13 depicts arrays in which the phosphors materials of RGBRGB . . . are coated in a row direction and the phosphors materials having the identical light emission colors are coated in a column direction.

Partition 17 for defining discharge space 20 and for separating among cells is located between insulating layer 15*a* on front substrate 10 and insulating layer 15*b* on back substrate 11. A discharge gas is enclosed within discharge space 20, which consists of a mixed gas selected from He, Ne, Ar, Kr, Xe $N_2$, $O_2$, $CO_2$ and the like. At least one of substrates 10 and 11 is transparent.

FIG. 10 is a plan view showing an electrode structure in the color PDP shown in FIG. 9. At the electrode structure in the color PDP shown in FIG. 10, m scan electrodes 12 $\{(S_i(i=1, 2, \ldots, m)\})$ are arranged in a row direction, n data electrodes 19 $\{D_j(i=1, 2, \ldots, n)\}$ are arranged in a column direction, and thus one cell is provided at a cross point thereof. Common electrodes 13 $\{(C_i(i=1, 2, \ldots, m)\}$ are arranged in the row direction so as to pair with scan electrodes $\{S_i\}$, thus both are in parallel to each other.

A conventional method for driving the PDP constructed as above will be explained bellow. FIG. 11 is a timing chart showing drive voltage waveforms applied to each of electrodes in the color PDP shown in FIG. 10.

First, erasing pulses 21 are applied to all the scan electrodes 12 to halt discharge states of cells which have emitted lights till the time shown in FIG. 11 and to bring them into erasing states. The term "erase" herein means an operation of reducing or annihilating wall charges as mentioned later.

Next, priming discharge pulses 22 are applied to common electrodes 13 so that all the cells may emit light by force with discharges, and then priming discharge erasing pulses 23 are applied to scan electrodes 12 in order to erase the priming discharges of all the cells. Priming discharge pulse 22 and priming discharge erasing pulses 23 may ease a write discharge as mentioned later.

After erasing the priming discharge, scan pulses 24 are applied to scan electrodes $S_1$–$S_m$ at different timings, and data pulses 27 are applied to data electrodes 19 ($D_1$–$D_n$) in accordance with the timing when the corresponding scan pulse 24 is applied. An oblique line depicted in data pulse 27 shows that presence/absence of data pulse 27 has been determined in accordance with presence/absence of the display data. When applying scan pulses 24, the write discharge may be caused within a discharge space 20 formed between scan electrode 12 and data electrode 19 only in the cells that are provided with data pulses 27, but not in the cells that are not provided with data pulses 27.

Positive charges called wall charges are accumulated on insulating layer 15*a* on scan electrodes 12 in the cells where there was caused the write discharge. At the same time, negative wall charges are accumulated on insulating layer 15*b* on data electrodes 19. Superimposing a positive potential due to the positive wall charges, which are generated on insulating layer 15*a* on scan electrodes 12, onto a first negative sustaining pulse 25, which is applied to common electrodes 13, may cause a first sustaining discharge. When the first sustaining discharge occurs, positive wall charges are accumulated on insulating layer 15*a* on common electrodes 13, and negative wall charges are accumulated on insulating layer 15*a* on scan electrodes 12. A second sustaining pulse 26 is superimposed on the potential difference between the wall charges so as to cause a second sustaining discharge. Thus, the potential difference between the wall charges generated by the sustaining discharges of a n-th time may be superimposed on the sustaining pulse of a (n+1)-th time to continue sustaining discharges. The continuation number of the sustaining discharges may control brightness.

If adjusting the voltages of sustaining pulses 25 and 26 previously at such values that can not cause discharges by only these pulse voltages themselves, the potential due to the wall charges is not present in the cells where there were not caused write discharges before applying the first sustaining pulses 25. Therefore, the first sustaining discharges can not occur in such cells even when applying the first sustaining pulses 25, and thus the following sustaining discharges will not occur accordingly. In general, frequencies for applying sustaining pulses 25 and 26 are about 100 kHz, respectively. Waveforms of these pulses are generally rectangular.

In the above explained drive voltage waveforms shown in FIG. 11, the duration for applying erasing pulse 21, priming discharge pulse 22 and priming discharge erasing pulse 23 is called a priming discharge period. The duration for applying scan pulse 24 and data pulse 27 is called a scan period, and the duration for applying sustaining pulses 25 and 26 is called a sustaining period. The priming discharge period, scan period and sustaining period in combination construct a sub-field.

Next, the conventional gradation display method in the PDP will be explained with reference to FIG. 12. A field is duration (for example, 1/60 second) for displaying one scene, and may be divided into a plural of sub-fields (for example, 4 sub-fields). Each sub-field has the configuration shown in FIG. 11 and can be controlled independently of other sub-fields with respect to ON/OFF of display. Each sub-field has a different length of sustaining period or the number of sustaining pulses, and a different brightness accordingly. In the case of 4 divided sub-fields as shown in FIG. 12, by adjusting each sub-field such that a ratio of lengths of sustaining periods, or a ratio of the numbers of sustaining pulses, or a ratio of brightness may come to 1:2:4:8, for example, a display with 16 gradation brightness, which includes brightness ratios of from 0 at the time when all sub-fields are not selected to 15 at the time when all sub-fields are selected, can be achieved in accordance with combinations of display ON/OFF in the sub-field.

Dividing one field into n sub-fields and setting the ratio of lengths of sustaining periods, or the ratio of the numbers of sustaining pulses, or the ratio of brightness per sub-field at 1 $(=2^0):2(=2^1): \ldots :2^{n-2}:2^{n-1}$ may perform $2^n$-gradation display.

However, in the case where the conventional method for driving the AC-PDP is employed to display an image, the contrast of the image in the dark place may be greatly affected by the brightness due to the priming discharge operation. This is because, even in the case of the brightness ratio of 0 as is in the darkest light emission state where all sub-fields are not selected, as the light emission due to the priming discharge operation in each sub-filed exists, a complete "black" display can not be obtained. In the conventional driving method, a measured value of brightness for "black" is about 5 cd/m$^2$, a measured value of brightness for "white" is about 150 cd/m$^2$, and thus a contrast ratio is about 30:1.

Thus, the conventional AC-PDP includes such a disadvantage that the contrast ratio is low because of high brightness caused by the priming discharge and priming discharge erasing.

JPA-8-221036 discloses a technology for improving the contrast ratio by effecting the priming discharge operation only in a part of sub-field or only in a part of cells. This conventional technology, however, requires an additional signal process for controlling priming discharge and thus complicates the apparatus.

Another method for improving the contrast ratio by introducing priming discharge cells used in DC-PDP into AC-PDP and shading the priming discharge cells is also known. The priming discharge cells are such cells that may only preliminarily discharge independently of the cells for displaying the image.

The conventional priming discharge cells, however, are realized to operate at such locations for causing priming discharge that differ simply from the locations for causing display discharge. Priming discharge operation is one of constituents that consist of sub-field and is not independent of display discharge from a view of driving operation though the locations are independent. Priming discharge is necessary to synchronize with other driving operations such as write discharge and sustaining discharge. This enables to minimize the number of priming discharges. Thus, the conventional technology has a disadvantage that it is necessary to coincide the timings of priming discharge, write discharge and sustaining discharge with one another for adjusting drive waveforms as in the case of a panel structure having no priming discharge cells.

SUMMARY OF THE INVENTION

The present invention is made in consideration of such the disadvantages, and thus has an object to provide a plasma display panel of an AC discharge type and a method for driving the same by which a reduction of brightness due to priming discharge, a needlessness to adjust priming discharge timing, an extremely high independence of driving and a high contrast ratio may be obtained.

According to a first aspect of the present invention, there is provided a plasma display panel of an AC discharge type for displaying an image, which comprises: a pair of substrates confronting each other and interposing a certain space therebetween, at least one of the substrates being transparent; a discharge gas enclosed within the space; a plural of priming discharge cells for causing priming effects; a plural of display cells for causing write and sustaining discharges of display data in accordance with the priming discharge effects, the priming discharge cells and the display cells being defined by dividing the space; display cell electrodes for controlling the discharges of the display cells; and at least two kinds of priming discharge electrodes disposed independently of the display cell electrodes, the priming discharge electrodes being driven so as to cause discharges at the priming discharge cells independently of the display cells.

In the plasma display panel of an AC discharge type, the priming discharge cells may be arranged along a row direction on a display plane at a ratio of one row of the priming discharge cells per one row or two rows of the display cells.

In the plasma display panel of an AC discharge type, the priming discharge cells may be arranged along a column direction on a display plane at a ratio of one column of the priming discharge cells per one column or two columns of the display cells.

In the plasma display panel of an AC discharge type, the priming discharge electrodes may comprise two electrodes disposed on one of the pair of substrates and in parallel to an arranging direction of the priming discharge cells; and priming discharge causing the priming effect occurs in a form of surface discharge.

In the plasma display panel of an AC discharge type, the priming discharge electrodes may comprise an electrode disposed on one of the pair of substrates and in parallel to an arranging direction of the priming discharge cells and another electrode disposed on the other of the pair of substrates and in parallel to the arranging direction of the priming discharge cells; and the priming discharge occurs in a form of opposing discharge through a discharge space.

In the plasma display panel of an AC discharge type, the priming discharge cell may not coated with a phosphors material.

In the plasma display panel of an AC discharge type, an opaque layer may be formed on a display plane of the priming discharge cell.

In the plasma display panel of an AC discharge type, the opaque layer may comprise a black electrode.

In the plasma display panel of an AC discharge type, the opaque layer may comprise a dielectric layer.

According to a second aspect of the present invention, there is provided a method for driving the plasma display panel of an AC discharge type, which comprises a step of:

applying priming discharge drive pulses for causing discharges in the priming discharge cells to the priming discharge electrodes independently of the display cells.

In the method for driving a plasma display panel of an AC discharge type, the priming discharge drive pulse for causing discharge in the priming discharge cell may comprise a sine wave pulse having a frequency of 50 kHz or less.

According to a third aspect of the present invention, there is provided a method for driving a plasma display panel of an AC discharge type for displaying an image, wherein said panel comprises: a pair of glass substrates confronting each other and interposing a certain space therebetween, at least one of said substrates being transparent; a discharge gas enclosed within said space; and a plural of display cells defined by dividing said space, which method comprises steps of causing priming discharge in said plural of display cells; causing write discharge in said plural of display cells; and causing sustaining discharge in said plural of display cells; wherein said priming discharge is caused by a priming discharge drive voltage which comprises a sine wave having a frequency of 50 kHz or less.

In the method for driving a plasma display panel of an AC discharge type, an image display field comprising said write discharges and sustaining discharges and a priming discharge field comprising said priming discharge may appear alternately on every other field and on every other scan line.

The present invention comprises at least two kinds of priming discharge electrodes disposed independently of the display cell electrodes. The priming discharge electrodes are controlled to drive independently of the display cells for causing discharges at the priming discharge cells. Thus, the priming effect may be obtained by using a low frequency sine wave driving method capable of realizing a lower brightness than that in the prior art, and then the display contrast ratio may be improved.

BRIEF DESCRIPTION OF THE DRAWINGS

The present invention will be more fully understood from the following detailed explanation taken in conjunction with the accompanying drawings in which.

DETAILED DESCRIPTION OF THE PREFERRED EMBODIMENTS

Figure 1:
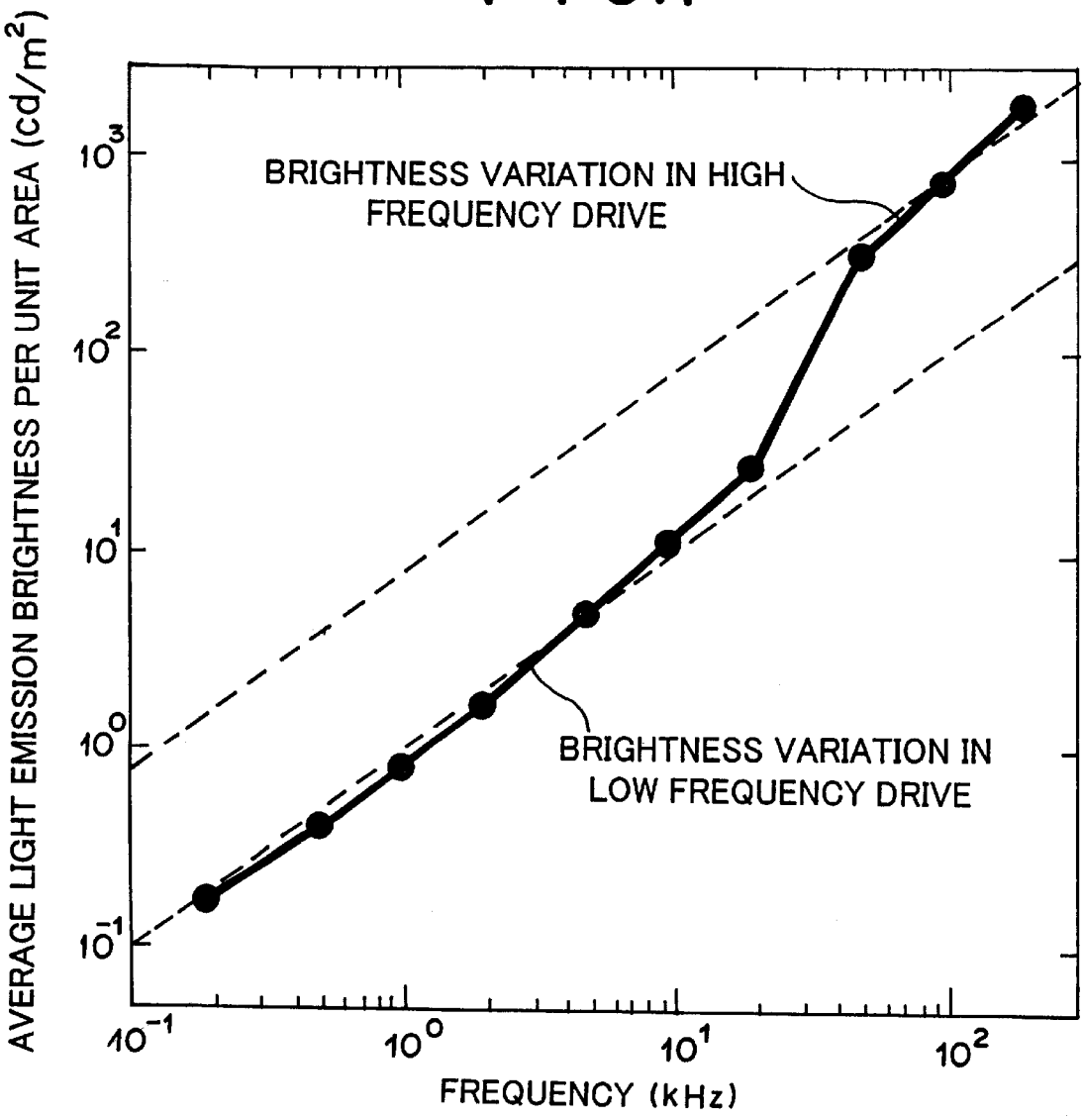
FIG. 1 is a diagram showing an example of relation between drive frequency and light emission brightness in a first embodiment of the present invention.

FIG. 1 is a characteristic diagram showing a relation between drive frequency and light emission brightness of PDP in the first embodiment of the present invention. The characteristic is measured when a potential difference between the scan electrode and the common electrode is sinusoidal, and the light emission brightness is an average of light emission brightness per unit area. A variation of light emission brightness is substantially proportional to the frequency however, the proportional constant in a low frequency region is smaller than that in a high frequency region.

The high frequency region resides in frequencies of more than 50 kHz and the low frequency region resides in frequencies of less than 20 kHz in FIG. 1. By using this characteristic, discharge is always caused in the priming discharge cell that is provided independently of the display cell by a low frequency sine wave drive with a drive control independent of a display drive. This discharge in the priming cell can be employed as a priming effect for the display cell.

The display discharge is caused in the high frequency drive region of 50 kHz or more in FIG. 1. The priming discharge is caused at a drive frequency of 50 kHz or less, and more preferably at a drive frequency of 20 kHz or less. The contrast ratio may be improved by the step occurred in the brightness characteristic close to the drive frequency of 50 kHz as shown in FIG. 1, which realizes a greater brightness ratio than a frequency ratio. The priming discharge is not limited, because of small brightness thereof, to occur only one time before write operation as was in the prior art. It may be caused several tens of times before writing. The display drive such as write and sustaining can be freely adjusted without consideration of the priming discharge timing.

Figure 2:
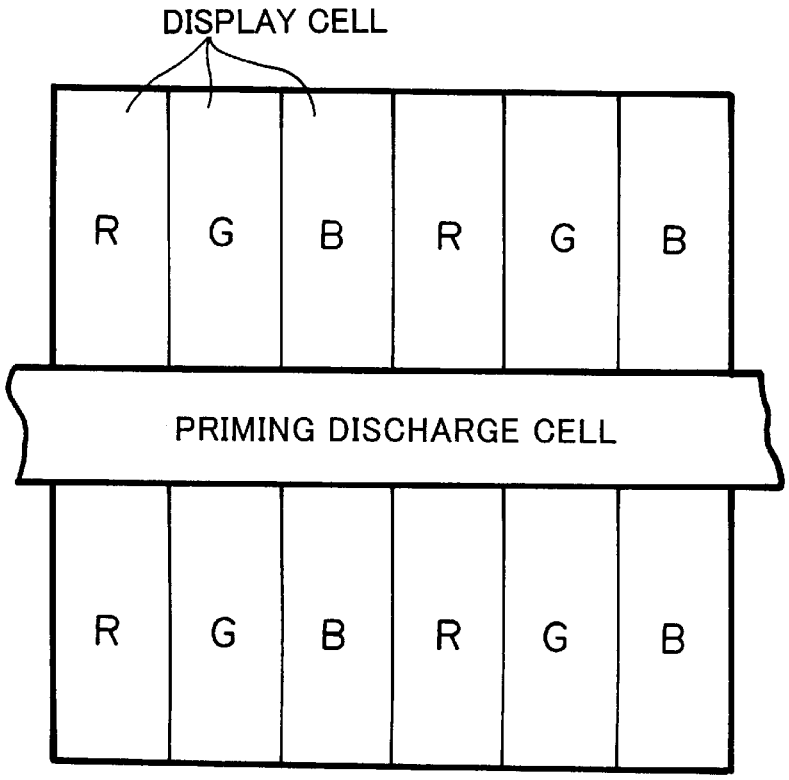
FIG. 2 is a schematic diagram showing an example of cell array in a second embodiment of the present invention.

FIG. 2 is a plan view showing a cell array of PDP in the second embodiment of the present invention. Priming discharge cells are formed between two rows of display cells that are arranged in RGBRGB . . . as shown in FIG. 2. Discharges caused in the priming discharge cells by applying a low frequency sine wave always independently of the display cells may serve as a source of priming effects to adjacent display cells. The cell array containing the range shown in FIG. 2 may be an alternate type array (display cell row–priming discharge cell row–display cell row–priming discharge cell row–. . . ) and an every third column type array (display cell row–display cell row–priming discharge cell row–display cell row–display cell row–priming discharge cell row–. . . ) in order to achieve the effect for improving the contrast.

Areas with respect to the priming discharge cell and display cell shown in FIG. 2 will be explained next. The brightness measurement in FIG. 1 shows a frequency characteristic regarding the discharges from the cells of the same type, that is, the same areas. For example, if the area ratio between the display cell and the priming discharge cell is determined 2:1, a contrast ratio of 3:1 can be obtained by a simple estimation even when causing discharges in the display cell and priming discharge cell with the same frequency. In the estimation, a dark brightness is defined as brightness caused by priming discharge while a light brightness is defined as a sum of brightness caused by priming discharge and brightness caused by display discharge. An effect of the present invention; a low brightness priming discharge by the low frequency sine wave drive, may be employed by lowering the drive frequency of priming discharge. For example, in the case where display discharge of about 1000 cd/$m^2$ caused by 100 kHz drive and priming discharge of about 1 cd/$m^2$caused by 1 kHz drive are employed and brightness of the display discharge is estimated to be ⅕ in consideration of scan period and the like, a contrast ratio of 401:1 can be obtained in combination with an area ratio of 2:1(1000×2×⅕+1=401). A further improved constant ratio can be expected by adding a means for shading the front substrate side of the priming discharge cells without coating any phosphors material on the priming discharge cells although the manufacturing process may be complicated.

Figure 3:
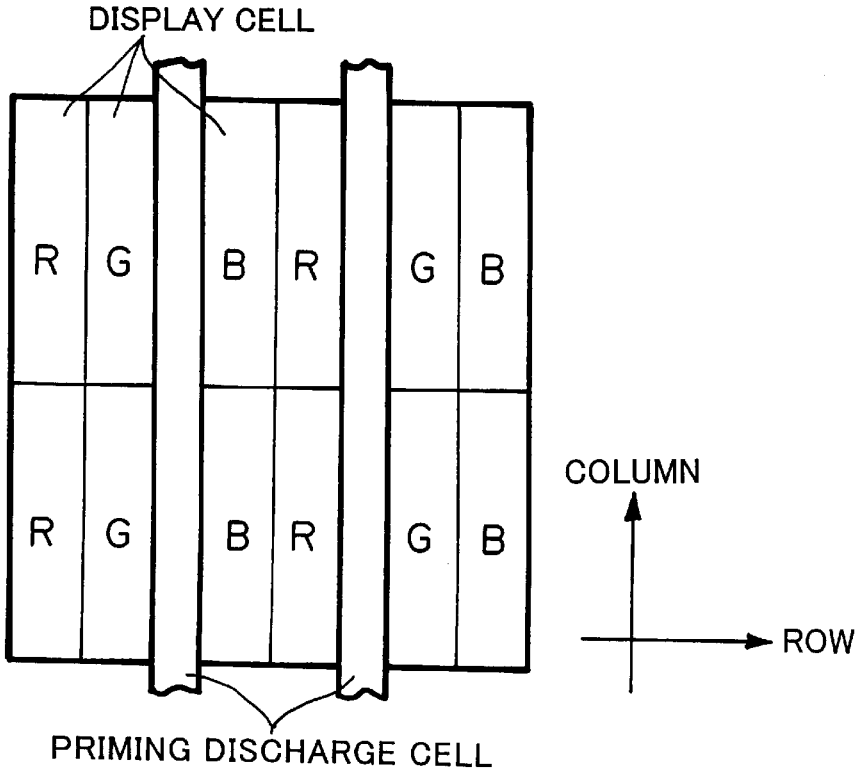
FIG. 3 is a schematic diagram showing an example of cell array in a third embodiment of the present invention.

FIG. 3 is a plan view showing a cell array of PDP in the third embodiment of the present invention. Priming discharge cells are formed between two columns of display cells that are arranged in RGBRGB . . . as shown in FIG. 3. Discharges caused in the priming discharge cells by applying a low frequency sine wave always independently of the display cells may serve as a source of priming effects to adjacent display cells. The priming discharge cell array may be the alternate type and the every third column type shown in FIG. 3 to achieve the effect of the present invention as well.

Figure 4:
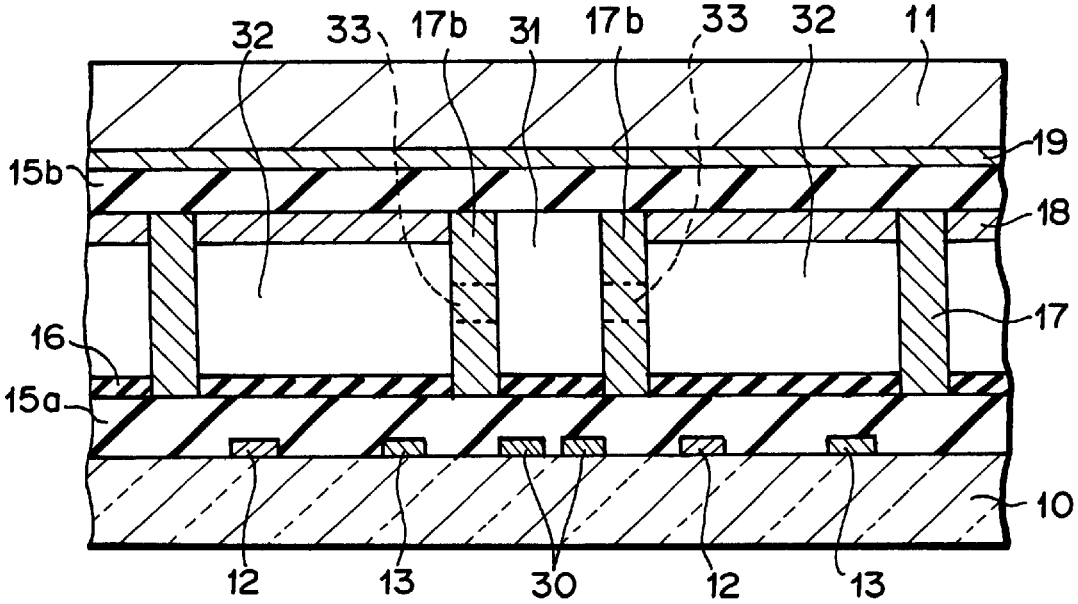
FIG. 4 is a diagram showing a cross sectional structure in a fourth embodiment of the present invention.
Figure 9:
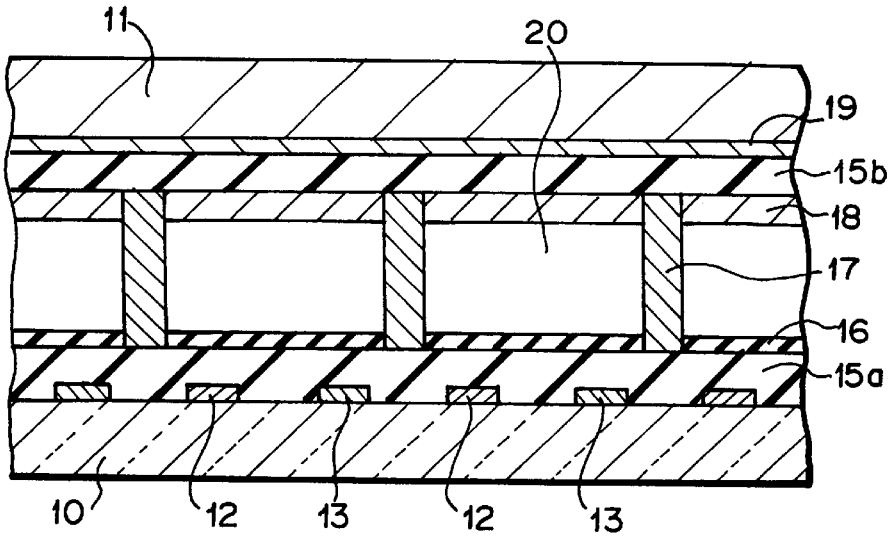
FIG. 9 is a diagram showing a cross sectional structure of the conventional PDP.
Figure 10:
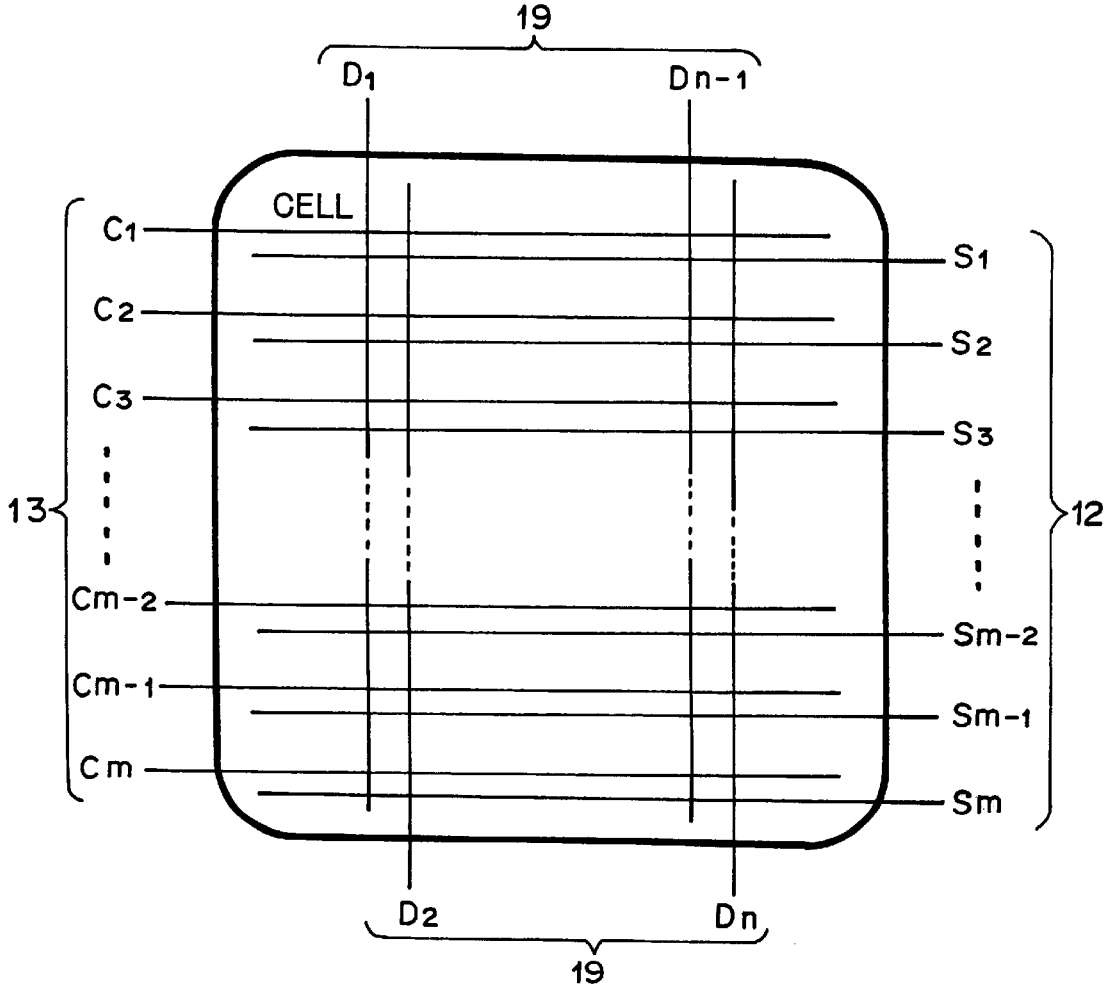
FIG. 10 is a plan view showing schematically an electrode arrangement of the PDP in FIG. 9.
Figure 11:
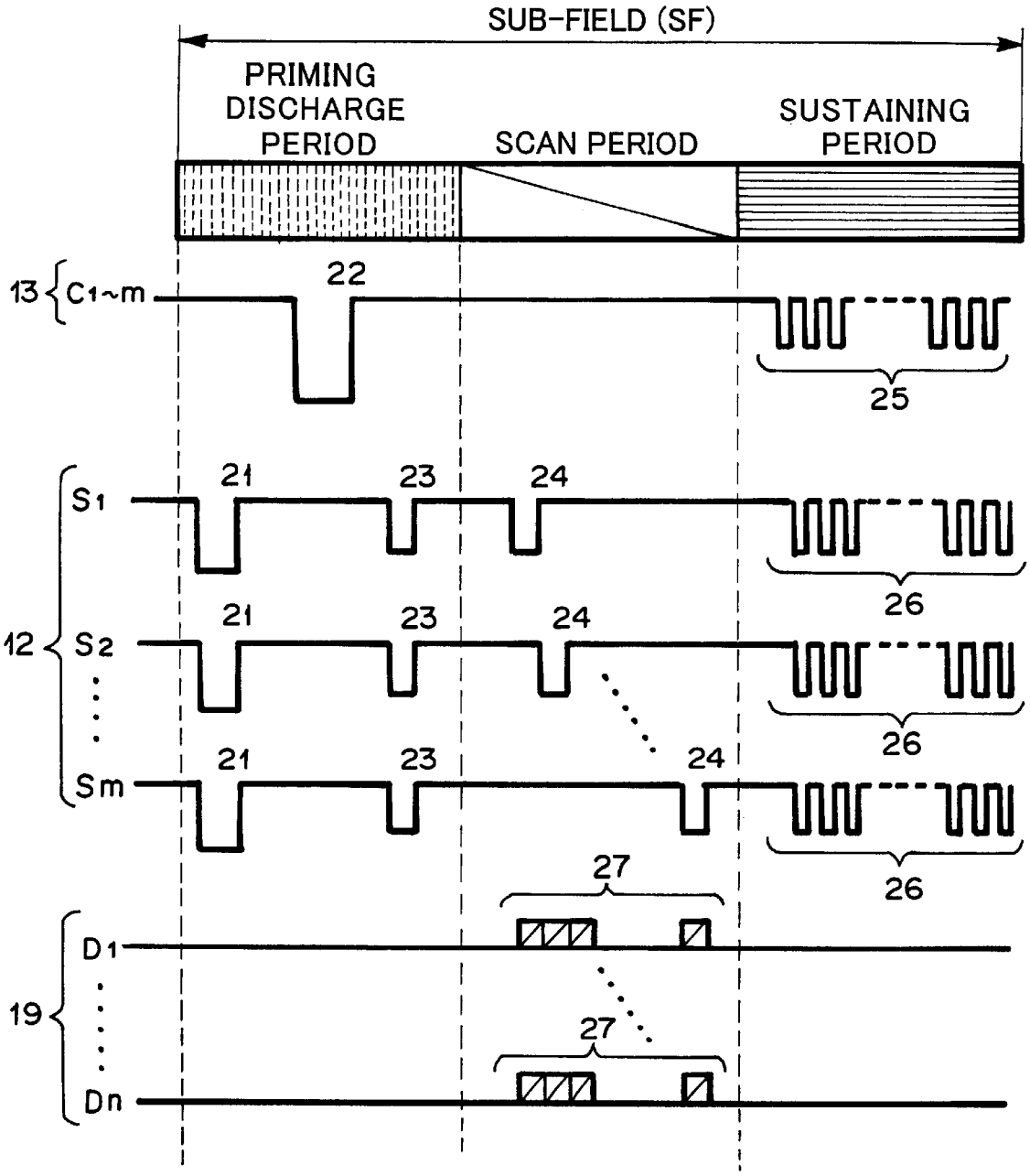
FIG. 11 is a waveform diagram showing an example of waveforms applied to each electrode of the PDP in FIG. 10.
Figure 12:
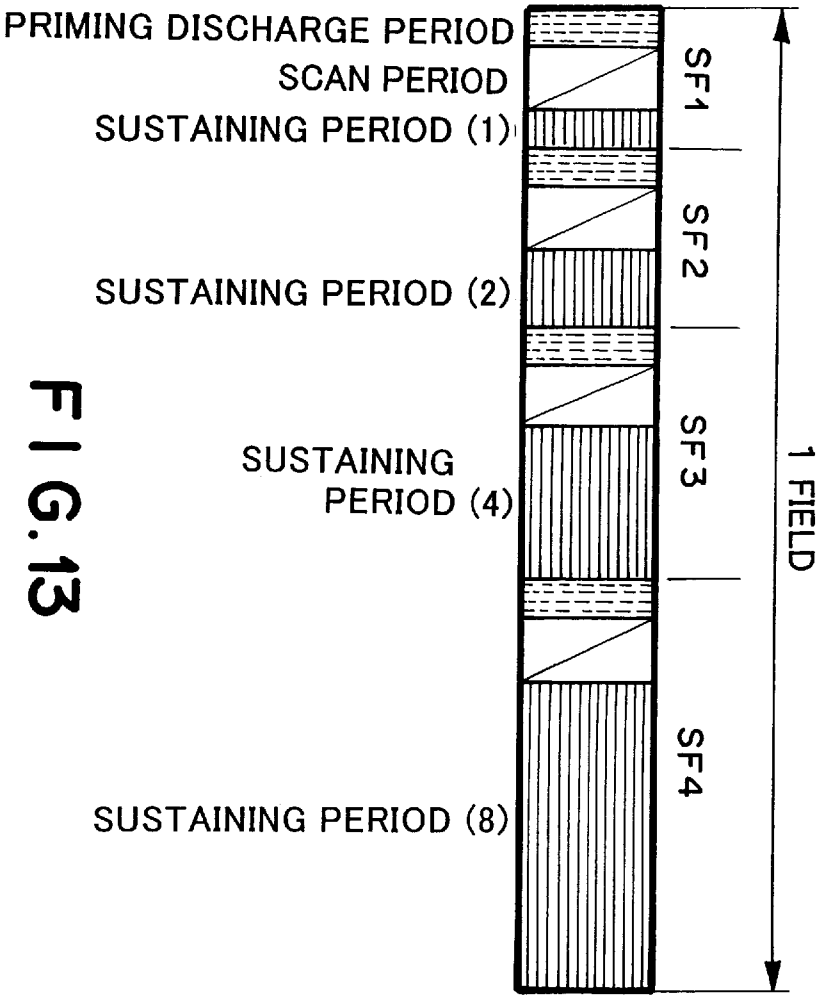
FIG. 12 is a timing chart explaining the conventional gradation display method.
Figure 13:
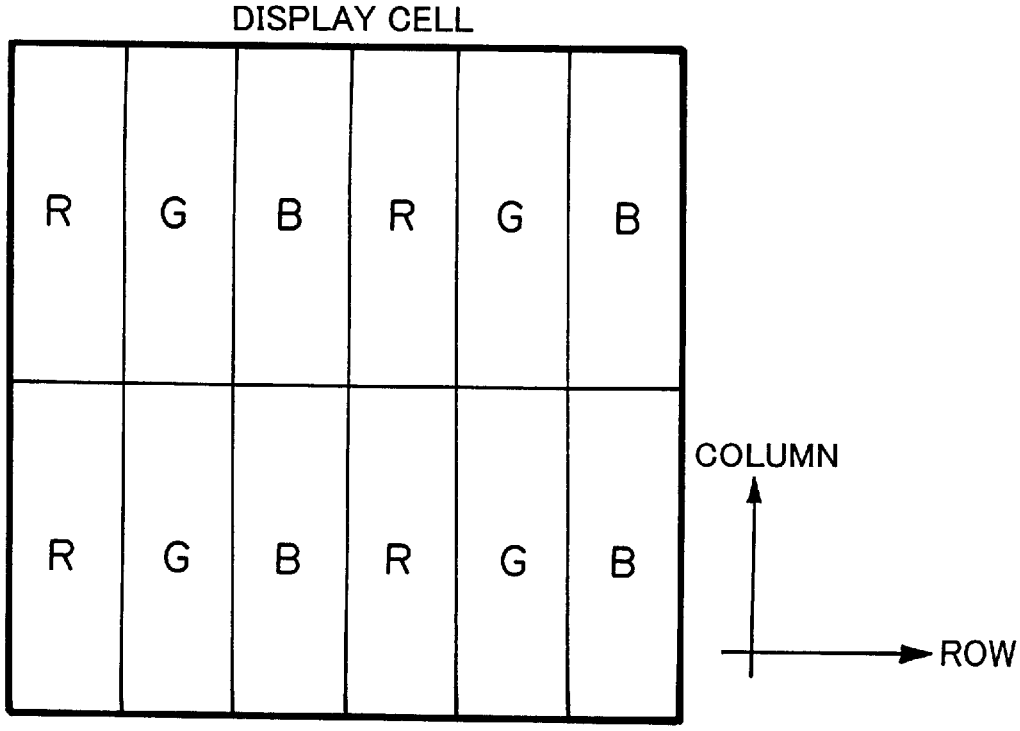
FIG. 13 is a schematic diagram showing an example of the conventional cell array.

FIG. 4 is a cross sectional view showing a cross sectional structure of PDP in the fourth embodiment of the present invention. In FIG. 4, the members having the same functions as those in FIG. 9 are given the identical numeral references and the detailed explanation thereof are omitted. Display cell rows and priming discharge cell rows are arranged in parallel as are in the second embodiment of the present invention. A pair of priming discharge electrodes 30 for priming discharge is arranged on the substrate, on which there are arranged common electrodes 13 and scan electrodes 12 for display, in parallel to and independently of the both. The priming discharge is therefore a surface discharge caused by the electrodes arranged on the same plane. Priming discharge cell 31 and display discharge cell 32 are separated by partition 17*b* which extends in a row direction in parallel to common electrode 13, scan electrode 12 and priming discharge electrode pair 30. A partition which extends in a column direction may also achieve the same effect of the invention. Rather, disposing such the column directional partition may reduce the opening ratio of priming discharge cell and may effect preferably on improvement of the contrast ratio. Partitions 17*b* for separating priming discharge cell from display cell are provided with holes 33 which may allow metastable level atoms and the like to pass through, which are factors of priming effect. No phosphors material is coated on the priming discharge cell in FIG. 4. Even if the phosphors material is coated, as the brightness thereof is low, thus the effect of the present invention can be achieved.

The same effect of the invention may be obtained by arranging the priming discharge electrode pair within the insulating layer on the back substrate, closer to the discharge space than the data electrode, and in parallel to the common and scan electrodes.

Figure 5:
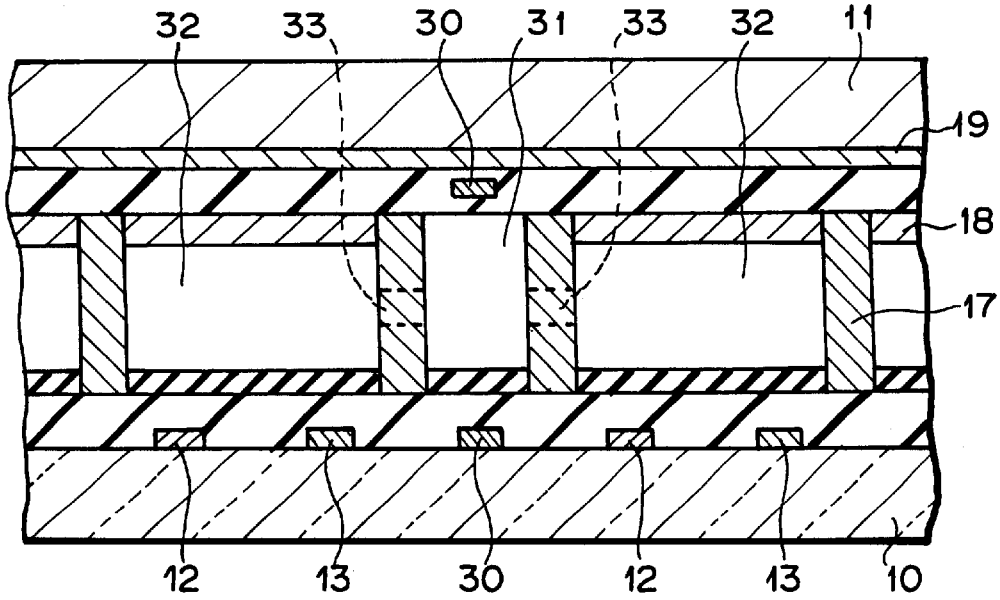
FIG. 5 is a diagram showing a cross sectional structure in a fifth embodiment of the present invention.

FIG. 5 is a cross sectional view showing a cross sectional structure of PDP in the fifth embodiment of the present invention. Display cell rows and priming discharge cell rows are arranged in parallel as are in the second embodiment of the present invention but in another manner. Priming discharge electrode pair 30 for priming discharge are arranged separately on individual substrates 10 and 11, interposing a priming discharge space 31 therebetween, in parallel to and independently of common electrodes 13 and scan electrodes 12 for display. The priming discharge of this case is an opposing discharge in the priming discharge cell caused by the electrodes which confront each other and interpose priming discharge space 31 therebetween. The fifth embodiment may reduce the number of electrodes on the front substrate side by one, narrow the width of the priming discharge cell, and improve the contrast ratio more compared to the fourth embodiment.

Figure 6:
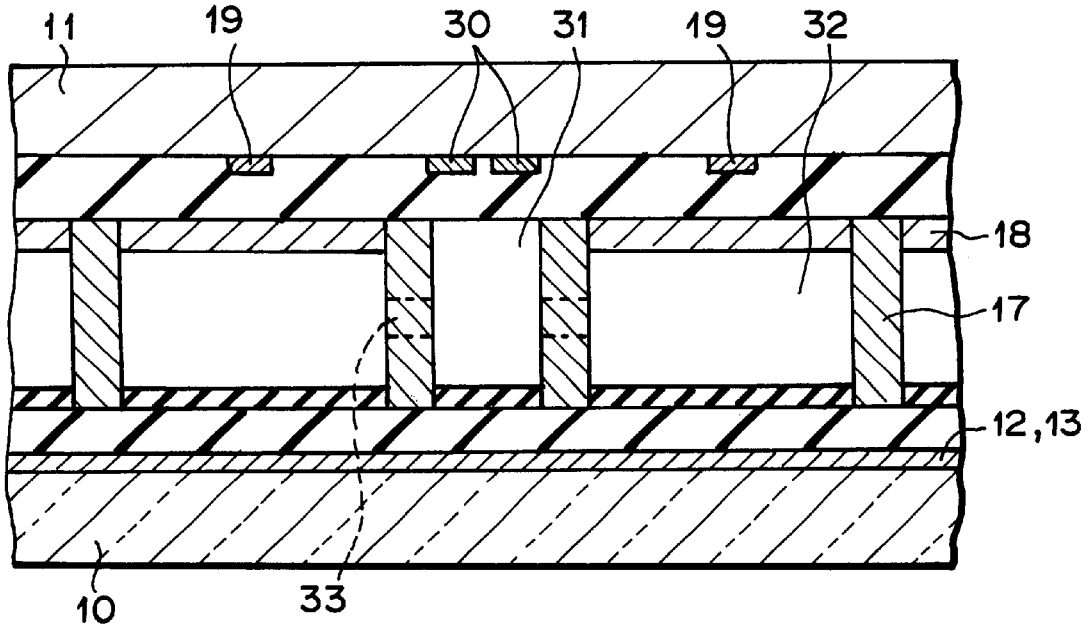
FIG. 6 is a diagram showing a cross sectional structure in a sixth embodiment of the present invention.

FIG. 6 is a cross sectional view, of which direction is normal to the directions in FIGS. 4, 5 and 9, showing a cross sectional structure of PDP in the sixth embodiment of the present invention. Display cell columns and priming discharge cell columns are arranged in parallel as are in the third embodiment of the present invention. A pair of priming discharge electrodes 30 for priming discharge is arranged on back substrate 11, on which there are arranged display electrodes 19 for display, in parallel to and independently of display electrodes 19. The priming discharge is the surface discharge. The partition and phosphors may affect as similar to those in the case where the column and row are read oppositely in the explanation for the fourth embodiment of the present invention.

The effect of the invention may also be obtained similarly even in the case of arranging the priming discharge electrode pair within the insulating layer on the front substrate, closer to the discharge space than the common and scan electrodes, and in parallel to the data electrodes.

Figure 7:
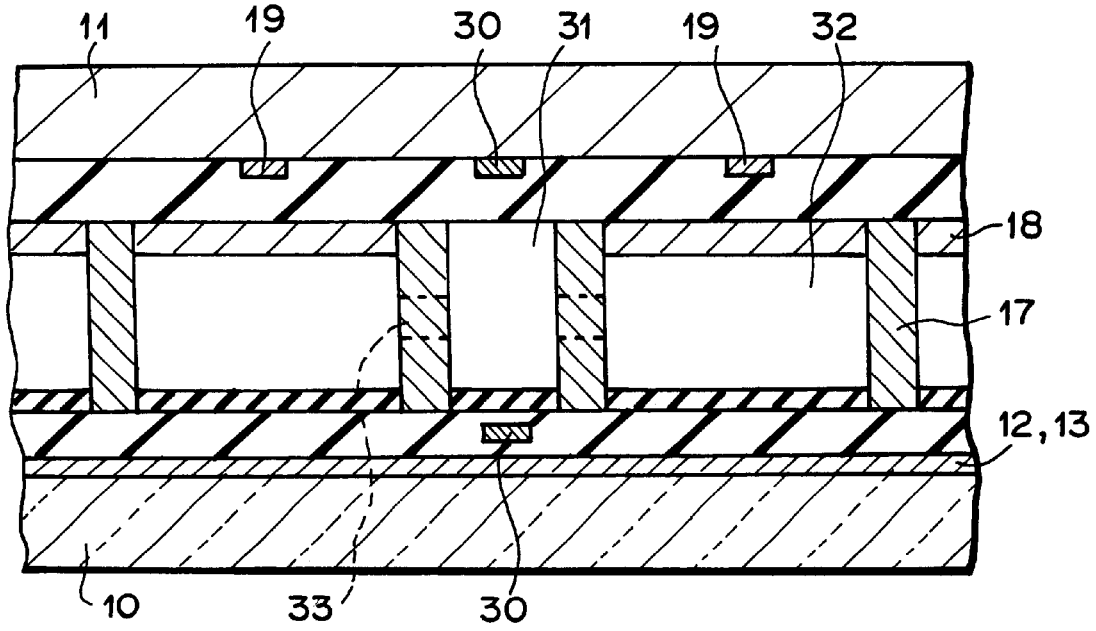
FIG. 7 is a diagram showing a cross sectional structure in a seventh embodiment of the present invention.

FIG. 7 is a cross sectional view, of which direction is normal to the directions in FIGS. 4, 5 and 9, showing a cross sectional structure of PDP in the seventh embodiment of the present invention. Display cell columns and priming discharge cell columns are arranged in parallel as are in the third embodiment of the present invention in another manner. Priming discharge electrode pair 30 for priming discharge are separately arranged on the individual substrates while interposing priming discharge space 31 therebetween and in parallel to display electrodes 19 for display. The priming discharge is the opposing discharge.

In the fourth to seventh embodiments of the present invention, the pair of priming discharge electrodes is not required to be transparent electrodes. Using black electrodes may achieve a high contrast ratio owing to improvement of a shading property for inner lights and reduction of a reflective index for outer lights.

The eighth embodiment of the present invention will be explained next with reference to FIG. 8, in which an example of driving voltage waveforms for applying to each electrode of PDP is shown. In AC-PDP having such the priming discharge electrodes as shown in the second to seventh embodiments, sine waves having opposite polarities to each other are applied always to a pair of priming discharge electrodes P1 and P2 independently of applying pulses to the other electrodes; i.e., common, scan and data electrodes. The pulses applied to common electrodes and scan electrodes, which have been necessary for priming discharge in the prior art are not required because the priming effect may be supplied to display cell from adjacent priming discharge cell. Therefore, the driving operation in the sub-field has such a sequence of sustain erasing→write→sustain, and thus can be shorter by omission of priming discharge operation than that in the prior art. A residue time caused by the above may be distributed to the scan and sustaining periods.

Figure 8:
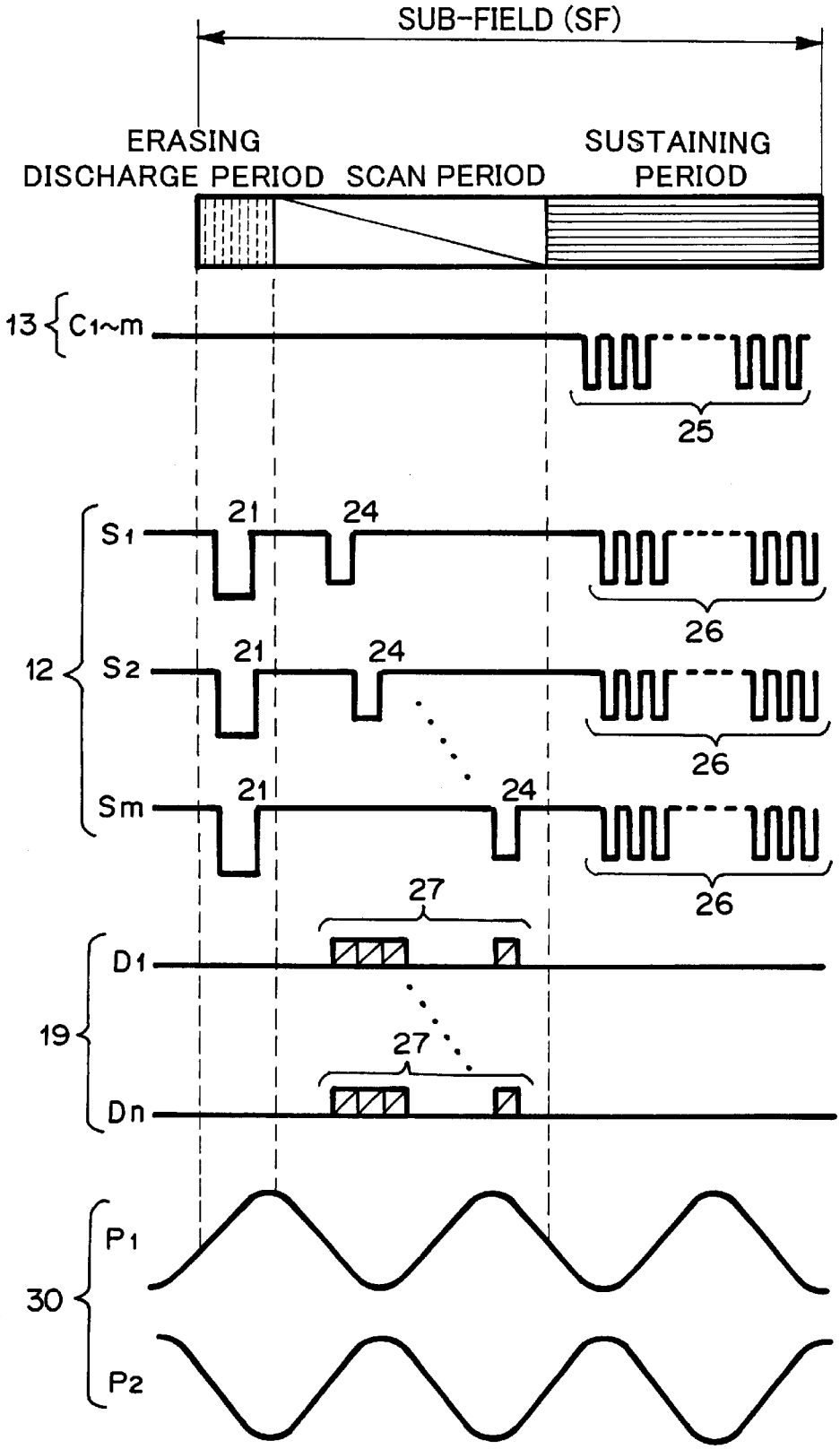
FIG. 8 is a waveform diagram showing an example of waveforms applied to each electrode in an eighth embodiment of the present invention.

The driving waveforms applied to the priming discharge electrode pair are not limited to the sine waves having opposite polarities to each other as shown in FIG. 8. Any other driving waveforms that can induce the low brightness discharge mode as explained in the first embodiment may also achieve the effect of the present invention. For example, a sine wave can be applied only to one electrode while another electrode is kept at a fixed potential. Further, sine waves having different wave heights may also be applied to two electrodes, respectively.

As the priming discharge cells are driven by the priming discharge electrode pair completely independent of the display cell drive, the priming discharge drive is not required to synchronize strictly with the display cell drive. Thus, the waveforms of display cell drive are freely determined without consideration of priming discharge.

A frequency of priming discharge will be explained next. In the conventional drive, 1 field period is determined to be 1/60 seconds and is divided into 8 sub-fields, for example. A light emission by priming discharge pulse and a light emission by priming discharge erasing pulse occur in each sub-field. Thus, the discharge frequency in the prior art was $60\times8\times2=960$ (1/s). In the case of the sine wave drive with drive frequency of 1 kHz for use in the second embodiment of the present invention, the discharge frequency is doubled to 2 kHz. According to the present invention, the priming effect is rather reinforced because the number of priming discharges per unit time is increase as well as the contrast ratio is improved owing to the lowered brightness in the priming discharge. On the contrary, determining the same priming discharge frequency as that in the prior art achieves improvement of the contrast ratio more.

Figure 14:
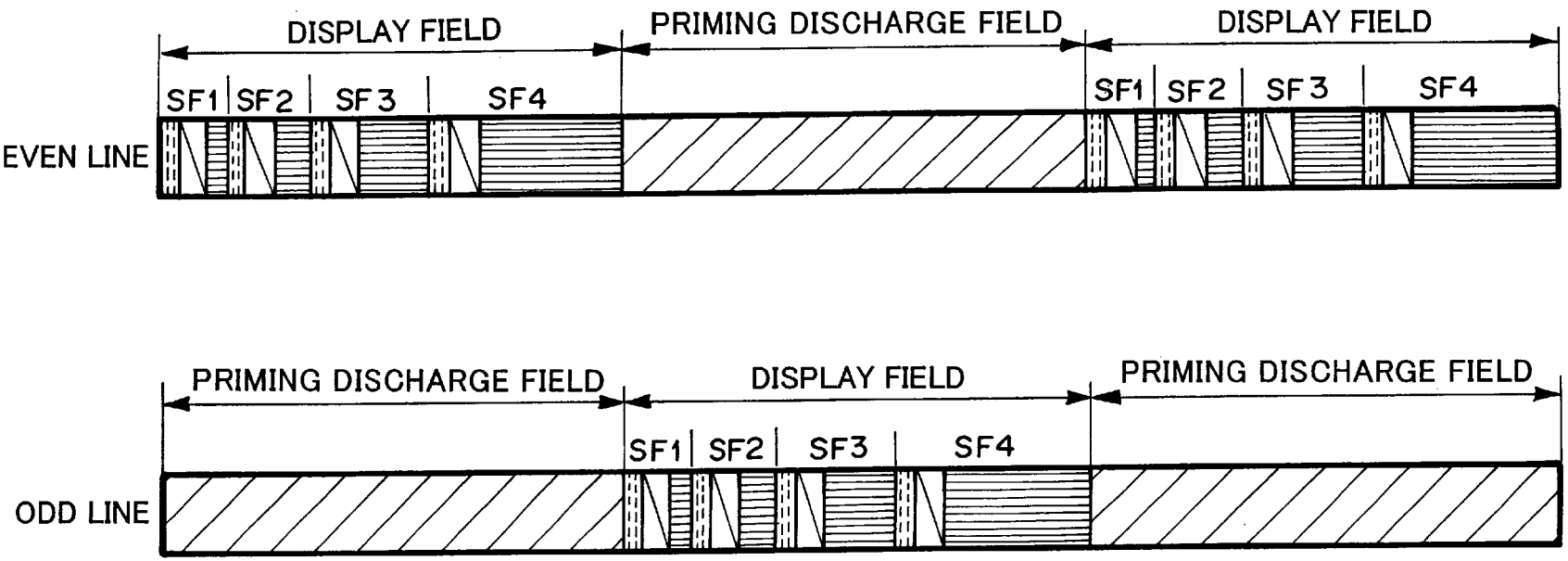
FIG. 14 is a timing chart showing an alternating structure of even rows and odd rows of display cells.

The ninth embodiment of the present invention will be explained next with reference to FIG. 14 which shows an arrangement of fields repeating in an even line and an odd line of the display cells. In the present embodiment, an image display field and a priming discharge field appear alternately on every other field and every other scan line in the conventional PDP structure having no priming discharge cells. Image display is performed in the image display field by the conventional sub-field dividing method. Priming discharge is performed in the priming discharge field with the low frequency sine wave pulses independently of display data. The priming discharge has a priming effect to an adjacent scan line. The priming discharge field on the even lines gives the priming effect to the image display field on the odd lines. The priming discharge field on the odd lines gives the priming effect to the image display field on the even lines. According to the present embodiment, as the display cell works as the priming discharge cell on every other field, any priming discharge cell is not required in the real panel structure.

According to the present invention, the contrast ratio is improved because the priming effect is obtained by driving the priming discharge cells which are disposed and driven independently of display cells with sinusoidal potentials of a low frequency.

Having described preferred embodiments of the invention, it will now become apparent to those of ordinary skill in the art that other embodiments incorporated these concepts may be used. Accordingly, it is submitted that the invention should not be limited to the described embodiments but rather should be limited only by the spirit and scope of the appended claims.

What is claimed is:

1. A plasma display panel of an AC discharge type for displaying an image, which comprises:

a pair of substrates confronting each other and interposing a certain space therebetween, at least one of said substrates being transparent;

a discharge gas enclosed within said space;

a plurality of priming discharge cells that cause priming effects;

a plurality of display cells that cause write and sustain discharges of display data in accordance with said priming effects, said priming discharge cells and said display cells being defined by dividing said space;

display cell electrodes that control said discharges of said display cells;

a first insulating layer that covers said display cell electrodes;

at least two kinds of priming discharge electrodes disposed independently of said display cell electrodes, said priming discharge electrodes being driven so as to cause discharges at said priming discharge cells independent of said display cells; and a second insulating layer that covers said priming discharge electrodes.

2. The plasma display panel of an AC discharge type according to claim 1, wherein said priming discharge cells are arranged along a row direction on a display plane at a ratio of one row of said priming discharge cells per one row or two rows of said display cells.

3. The plasma display panel of an AC discharge type according to claim 1, wherein said priming discharge cells are arranged along a column direction on a display plane at a ratio of one column of said priming discharge cells per one column or two columns of said display cells.

4. A plasma display panel of an AC discharge type according to claim 1, wherein said priming discharge electrodes comprises two electrodes disposed on one of said pair of substrates and in parallel to an arranging direction of said priming discharge cells; and wherein priming discharge causing said priming effect occurs in a form of surface discharge.

5. The plasma display panel of an AC discharge type according to claim 1, wherein said priming discharge electrodes comprises an electrode disposed on one of said pair of substrates and in parallel to an arranging direction of said priming discharge cells and another electrode disposed on the other of said pair of substrates and in parallel to the arranging direction of said priming discharge cells; and wherein said priming discharge occurs in a form of opposing discharge through a discharge space.

6. The plasma display panel of an AC discharge type according to claim 1, wherein said priming discharge cell is not coated with a phosphor.

7. The plasma display panel of an AC discharge type according to claim 1, wherein an opaque layer is formed on a display plane of said priming discharge cell.

8. The plasma display panel of an AC discharge type according to claim 7, wherein said opaque layer comprises a black electrode.

9. The plasma display panel of an AC discharge type according to claim 7, wherein said opaque layer comprises a dielectric layer.

10. The plasma display panel of claim 1, wherein at least one of said priming discharge cells is not coated with a phosphor.

11. The plasma display panel of claim 1, wherein at least one of said display cells generates a color display.

12. The plasma display panel of claim 11, wherein at least one of said priming discharge cells is not coated with a phosphor.

13. The plasma display panel of claim 1, wherein said priming discharge cells do not display data, and said display cells do not cause priming effects.

14. A plasma display panel of an AC discharge type for displaying an image, which comprises:

a pair of enclosing means for enclosing a discharge gas in a space between said pair, at least one of said pair of enclosing means being transparent;

a priming means for causing priming effects;

a display means for causing write and sustaining discharges of display data in accordance with said priming effects, said priming means and said display means being defined by dividing said space;

a display controlling means for controlling said discharges of said display means; and at least two priming discharge means disposed independently of said display controlling means, said priming discharge means being driven for causing discharges at said priming means independent of said display means, wherein said display controlling means and said priming discharge means are insulated.

15. The plasma display panel of claim 14, further comprising an opaque insulating means formed on said priming means, said opaque insulating means comprising one of a black electrode and a dielectric layer.

16. The plasma display panel of claim 14, wherein said priming means is interspersed between one of at least one row and at least one column of said display means.

17. The plasma display panel of claim 14, wherein said priming discharge means comprises electrodes disposed on one of said pair of substrates and is parallel to said priming means, and wherein a surface discharge causes said priming effect.

18. The plasma display panel of claim 14, wherein said priming discharge means comprises a first electrode positioned at one of said pair of substrates and a second electrode coupled at another of said pair of substrates, said first electrode and said second electrode being positioned parallel to said priming means, and wherein an opposing discharge causes said priming discharge.

* * * * *